United States Patent [19]

Wollet

[11] Patent Number: 4,660,706

[45] Date of Patent: Apr. 28, 1987

[54] COIN RECEIVING MECHANISM HAVING A SLIDEABLE DOOR TO PREVENT COIN INSERTION AFTER STUFFING

[75] Inventor: William M. Wollet, Huntsville, Ala.

[73] Assignee: GTE Communication Systems Corporation, Northlake, Ill.

[21] Appl. No.: 789,693

[22] Filed: Oct. 21, 1985

[51] Int. Cl.[4] ..... G07F 1/02

[52] U.S. Cl. ..... 194/351; 109/55; 232/44

[58] Field of Search ..... 194/202, 351, 321, 323, 194/347, 348, 349; 109/55, 66, 24.1; 70/423, 427, DIG. 41; 232/7, 15, 44

[56] References Cited

U.S. PATENT DOCUMENTS 683,280 9/1901 Hofheimer ..... 194/202

1,031,833 7/1912 Boswell ..... 194/351 X

FOREIGN PATENT DOCUMENTS 208850 1/1924 United Kingdom ..... 194/202

*Primary Examiner*—H. Grant Skaggs
*Assistant Examiner*—Edward S. Ammeen
*Attorney, Agent, or Firm*—Townsend and Townsend

[57] ABSTRACT

A special door is added to the coin receiving mechanism of a pay telephone or other vending machine to discourage the practice of stuffing the mechanism with paper or other foreign matter to trap deposited coins. A slot in the door is normally aligned with the regular slot for coin deposit. If stuffing occurs, the door slides over, misaligning the two slots and preventing deposit of any further coins.

5 Claims, 3 Drawing Figures

COIN RECEIVING MECHANISM HAVING A SLIDEABLE DOOR TO PREVENT COIN INSERTION AFTER STUFFING

BACKGROUND OF THE INVENTION

1. Field of the Invention

This invention relates to coin telephones sometimes referred to as telephone paystations and more particularly to apparatus for inhibiting or frustrating the efforts of vandals or thieves, who in order to obtain coins from such telephones stuff cloth, paper, etc. into the coin deposit or lead in chute, returning after sometime to collect those coins that have been lodged in the chute because of the previous stuffing.

2. Description of the Prior Art

A continuing problem in the field of coin telephones is the effort to abscond with deposited coins by stuffing the lead in or coin deposit chute with cloth, paper or similar material into the coin slot. When this is done the coins that are deposited subsequently are caught behind the stuffing and cannot be retrieved by operating the coin release lever. The thief then with a wire or similar instrument either pulls out the stuffing or manipulates it so the coins fall into the coin return chute and subsequently pockets the coins.

In the design of coin acceptor-rejecters as utilized in those telephones manufactured by GTE Communication Systems Corporation as well as in many of the acceptor-rejecters employed in other coin operated devices, no successful design has been created to overcome the previously outlined problem. The present problem did not develop until the use of the single slot paystation became widely accepted. Prior to that the multiple coin slot units employed in most coin telephones were not subject to the problem of coin stuffing. The subject invention is designed for industry standard acceptor-rejecters as manufactured by the CoinCo Corporation and those manufactured by Coin Accepters Incorporated.

SUMMARY OF THE INVENTION

The solution to the presently outlined problem consists of adding a metal plate that closes the coin deposit slot if any stuffing is inserted. This metal plate, which is held in grooves adjacent to the coin lead in chute, is attached to the usual lead in chute door by means of a pin. When stuffing occurs the lead in chute door is forced to open wider and this action then pulls the connected metal plate across the coin slot thus inhibiting the deposit of future or additional coins. In this manner the thief or vandal is frustrated because the dropping of additional coins is not permitted and therefore there is no economic advantage in returning to remove coins that have not been deposited. The incorporated metal plate has a coin slot through it, so that in the normal position if a coin is deposited in the coin chute it passes through that slot and into the coin deposit portion of the coin acceptor-rejecter mechanism.

DESCRIPTION OF THE PREFERRED EMBODIMENT

Figure 1:
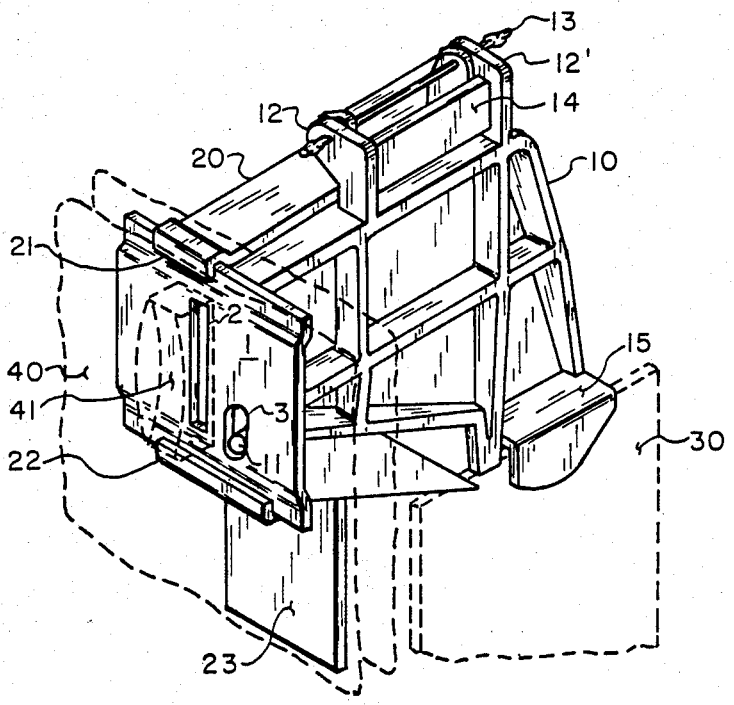
FIG. 1 is a perspective view of anti-stuffing device for use with coin telephones or similar vending machine devices in accordance with the present invention. The vending machine itself and the associated slot therein are shown in phantom in the present drawing.

Referring first to FIG. 1, a coin anti-stuffing door 1 is shown supported or mounted to a coin lead in chute 20. Also mounted to the coin lead in chute 20 is a coin lead in chute door 10. The coin lead in chute door 10 also engages or is connected to the coin gate that is part of a standard acceptor-rejecter design as previously outlined. The entire mechanism is then placed behind the face plate of a vending machine or coin telephone 40 and specifically in line with the vending machine or coin telephone coin receiving slot 40 as shown in FIG. 1. The coin anti-stuffing door has including therein a coin slot 2 and a pin engaging slot 3 which is arranged to receive a pin 11 attached to the coin lead in chute door 10.

The anti-stuffing door 1 is retained in grooves that are part of two supports 20 and 20' (not shown) both which have groove sections 21 and 22 respectively mounted thereon and adapted to engage the upper and lower edges respectively of the anti-stuffing door 1, these grooves permit lateral movement of the anti-stuffing door in a manner that will be described hereinafter. The lead in chute door 10 is mounted to the coin lead in chute 20 by means of two projecting ear-like sections 12 and 12' which are fastened to the coin lead in chute 20 by means of an end 13 which allows the coin lead in chute door 10 to move in an arcuate direction about pin 13 which is retained by the coin lead in chute 20. Located between the upstanding ears 12 and 12' is a support section or strengthening rib 14 also a portion of the coin lead in chute door 10. Attached to the lower portion of the chute 10 is a protrusion 15 which is adapted to engage coin gate in the acceptor rejecter mechanism 30 in accordance with the present invention. The entire mechanism being mounted to the coin telephone or vending machine by means of mounting flange 23 in the manner as shown in FIG. 1.

Figure 2:
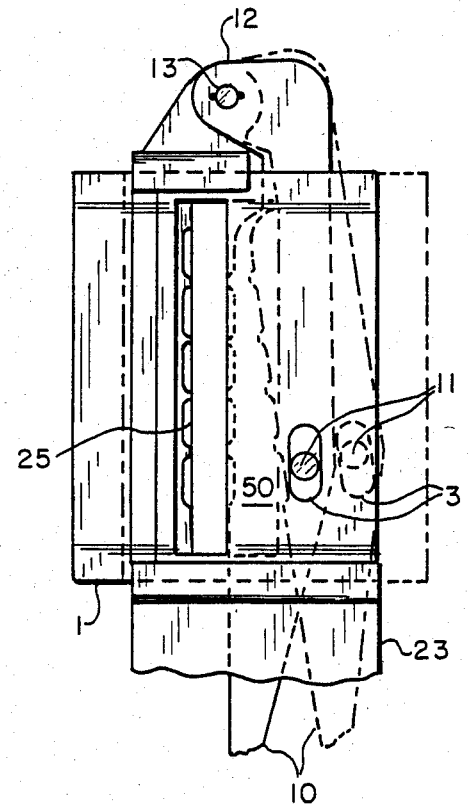
FIG. 2 is a front view of an anti-stuffing device in accordance with the present invention showing the device in its normal or non-operated position and shown in phantom in its operated position when the attempt has been made by a vandal or a thief to stuff a coin operated device to prevent the return of coins in the normal manner.
Figure 3:
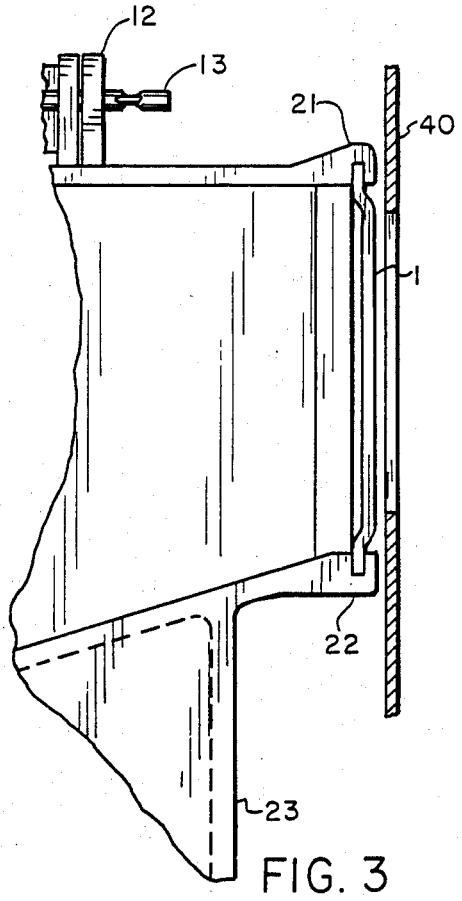
FIG. 3 is a side view of a anti-stuffing device in accordance with the present invention.

A better understanding of the present invention and how it functions will be taken in connection with the following description which shall describe the manner in which the anti-stuffing device of the present invention is utilized. Reference is made to both FIG. 1 and FIG. 2 wherein if a thief or a vandal places paper or similar material 50 through the vending machine coin slot 41 that material will then pass through the coin slot 2 in the anti-stuffing door and is wedged between the wall 25 of the coin chute 20 and the coin lead in chute door 10 as seen in FIG. 2. Since this door is pivoted, as additional stuffing material is added the door revolves around pin 13 by virtue of its engagement via pin 11 in slot 3 which causes the anti-stuffing door to slide across in a lateral motion causing the coin slot 2 therein to no longer be in direct alignment with the coin slot 41 in the faceplate 40 so that insertion of any further material or subsequent insertion of any coins is inhibited thus defeating the attempt at thievery or vanadlism as is the usual case with the single slot coin chute as set forth in the present invention.

Should sufficient material be stuffed in before the slot closes any additional stuffing will act against coin gate 30, which by means of its engagement with the coin lead in chute door 10 and by means of attachment or engagement with protrusion 15, the door will also be forced over far enough so as to to realign or misalign the two coin slot openings thus inhibiting the deposit or insertion of further materials.

While but a single embodiment of the present invention has been shown it will be obvious to those skilled in the art that numerous modifications can be made without departing from the scope of the present invention which shall be limited only by the claims appended hereto.

What is claimed is:

1. Apparatus for preventing the deposit of coins through a coin receiving opening into a coin receiving mechanism of a coin operated device, after said mechanism has been stuffed with foreign matter, said apparatus comprising: a slideable door positioned between said coin receiving opening and said coin receiving mechanism, and including an opening therethrough normally aligned with said coin receiving opening; coupling means connecting said coin receiving mechanism to said door, operated in response to the stuffing of foreign matter into said coin receiving mechanism through said coin receiving opening, to slide said door in a direction so as to misalign said openings whereby the deposit of coins into said coin receiving mechanism is prevented; said coin receiving mechanism including a wall portion; and a door portion pivotly fastened to said wall portion and operated in response to stuffing of foreign matter into said coin receiving mechanism to cause said door portion to move away from said wall portion in an arcuate manner about said pivot.

2. Apparatus as claimed in claim 1, wherein: said coin receiving mechanism includes means to support said door and to facilitate the sliding of said door.

3. Apparatus as claimed in claim 2, wherein: said means comprise a pair of grooved brackets adapted to engage said door and to facilitate sliding of said door so as to misalign said opening in said door with said coin receiving opening.

4. Apparatus as claimed in claim 1, wherein: said coupling means comprise a slot in said slideable door and a pin projecting from said door portion into said slot, said pin engaging said door and causing it to slide to misalign said openings in response to the movement of said door portion in an arcuate manner in response to the stuffing of foreign matter into said coin receiving mechanism.

5. Apparatus as claimed in claim 4, wherein: said pin is adapted to move in a vertical direction in said slot of said slideable door to cause said slideable door to move in a horizontal direction.

* * * * *